US005969580A

United States Patent [19]

Maillet et al.

[11] Patent Number: 5,969,580

[45] Date of Patent: Oct. 19, 1999

[54] TRANSITION BETWEEN A RIDGE WAVEGUIDE AND A PLANAR CIRCUIT WHICH FACES IN THE SAME DIRECTION

[75] Inventors: Olivier Maillet, Nanterre; Jean-Claude Cruchon, Bouffemont; Bernard Rattay, Mery sur Oise, all of France

[73] Assignee: Alcatel, Paris, France

[21] Appl. No.: 08/941,672

[22] Filed: Sep. 30, 1997

[30] Foreign Application Priority Data

Oct. 1, 1996 [FR] France ..... 96 11941

[51] Int. Cl.[6] ..... H01P 5/107

[52] U.S. Cl. ..... 333/26; 333/33; 333/34

[58] Field of Search ..... 333/26, 33

[56] References Cited

U.S. PATENT DOCUMENTS

| | | | |
|---|---|---|---|
| 4,725,793 | 2/1988 | Igarashi | 333/26 |
| 4,754,239 | 6/1988 | Sedivec | 333/26 |
| 5,262,739 | 11/1993 | Dalman | 333/26 |
| 5,361,049 | 11/1994 | Rubin et al. | 333/26 |

FOREIGN PATENT DOCUMENTS

| | | | |
|---|---|---|---|
| 67803 | 3/1980 | Japan | 333/26 |
| 1202001 | 8/1989 | Japan | 333/26 |
| 167902 | 7/1991 | Japan | 333/26 |
| 1317527 | 6/1987 | Russian Federation | 333/26 |

*Primary Examiner*—Benny Lee
*Attorney, Agent, or Firm*—Sughrue, Mion, Zinn, Macpeak & Seas, PLLC

[57] ABSTRACT

The invention relates to a transition between a ridge waveguide and a planar circuit on which a conductor is provided. The transition includes at least one conductive link connecting the end of said ridge to said conductor between two contact points. According to the invention, the contact points face a common access provided for putting the conductive link in place. It is thus possible to implement the contact points industrially, e.g. by means of a thermocompression machine.

12 Claims, 3 Drawing Sheets

TRANSITION BETWEEN A RIDGE WAVEGUIDE AND A PLANAR CIRCUIT WHICH FACES IN THE SAME DIRECTION

The invention relates to the field of microwave transition elements, and relates more precisely to a transition between a ridge waveguide and a planar circuit.

BACKGROUND OF THE INVENTION

A transition is a passive microwave element making it possible to go from one means of propagation to another. It is thus possible to transmit a microwave signal through a system comprising waveguides of different shapes, e.g. rectangular and circular waveguides, microstrip lines, striplines, and/or coaxial cables.

It is frequently necessary to transmit a signal between a waveguide and a planar circuit. A ridge waveguide is a rectangular or circular waveguide provided with a metallic ridge. The planar circuit may be constituted by a microstrip circuit, by a coplanar circuit with or without a ground plane, or by a suspended microstrip circuit.

In a known manner, the transition may be of the type having localized constants or of the type having distributed constants:

A localized-constant transition between a waveguide and a planar circuit is shorter than the wavelength of the guided wave. It is usually constituted by a probe penetrating into the waveguide perpendicularly to the direction in which the waveguide extends, and connected to the planar circuit. The probe is constituted by the core of the coaxial cable or by an etched metal-plated line on a substrate whose opposite face is locally stripped of its metal plating. The drawback with that type of transition is that it requires the direction of the microwave signal to be changed through 90°, and the overall size of the transition is then large. This applies to E-plane and H-plane transitions. In addition, such transitions are difficult to implement and they do not offer a wide matching band.

A distributed-constant transition is no shorter than the wavelength of the guided wave. It is usually constituted by a smoothly-varying or stepped impedance transformer. That end of the impedance transformer which is situated at the transition has a ridge-shaped cross-section (see FIG. 5). That type of transition has a wider bandwidth. Reference may be made, for example, to French Patent Application No. 2 552 586 as applied to a transition between a waveguide and a coaxial line or a microstrip line.

The principle of that solution is described with reference to FIG. 1 which is a section view of a transition between a waveguide and a microstrip line, as described in the work "Microwave transition design" by J. S. and S. M. Izadian, Artech House 1988, Page 54, FIG. 4.1.

In FIG. 1, a waveguide 10 includes a cover 11 to which a ridge forming a smoothly-varying impedance transformer 12 is fixed. The ridge 12 is at the center of the waveguide 10, and its free end 13 is put in contact with a conductor 14 by putting the cover 11 in place, the conductor being mounted on a substrate 15 whose bottom face constitutes a ground plane. The conductor 14, the substrate 15 and the ground plane constitute a microstrip line. Electrical continuity is thus provided between the ridge 12 and the line 14.

The drawback with that solution is that it makes it necessary to comply with tight manufacturing tolerances in order for the electrical contact to be good. In addition, contact problems arise in the presence of thermal expansion.

A solution remedying that drawback consists in providing a flexible conductive link between the end of the ridge and the conductor provided on the planar circuit.

FIG. 2 is a section view of such a transition with reference numerals 10–15 identifying the same elements as like reference numerals already described in FIG. 1.

In a first configuration, the conductive link is referenced 20, and is represented by an uninterrupted line. The link 20 connects the end of the ridge 12 to the conductor 14 of the planar circuit, the contact points being referenced 21 and 22. In a second configuration, the conductive link is referenced 23 and is represented by a dashed line. The link 23 has contact points referenced 24 and 25.

The drawback suffered by those two configurations is that the links 20 and 23 cannot be put in place industrially (e.g. by means of a thermocompression machine) because the contact points 21 & 22 and 24 & 25 are not accessible from identical directions. By way of example, with respect to the link 20, a thermocompression machine that is to make the contact point 20 must have access in direction 26, while, to make the contact point 22, it must have access in direction 27. This means that two openings must be provided enabling access to be given, and that the transition must be turned over between two thermocompressions. Similarly, with respect to the link 23, the access directions for the thermocompression machine are 27 and 28, and the same problem arises.

OBJECTS AND SUMMARY OF THE INVENTION

A particular object of the present invention is to mitigate those drawbacks.

More precisely, an object of the invention is to provide a transition between a ridge waveguide and a planar circuit, which transition provides excellent impedance matching over a wide frequency band, while being easy to manufacture industrially.

That object and others that appear below are achieved by a transition between a ridge waveguide and a planar circuit on which a conductor is provided, the transition including at least one conductive link connecting the end of the ridge to the conductor between two contact points, the contact points facing a common access provided for putting the conductive link in place.

The contact points can thus be implemented by a machine because only one access direction is necessary for putting the conductive link in place.

BRIEF DESCRIPTION OF THE DRAWINGS

Other characteristics and advantages of the invention appear on reading the following description of a preferred embodiment, given by way of non-limiting example, and with reference to the accompanying drawings, in which.

MORE DETAILED DESCRIPTION

Figure 1:
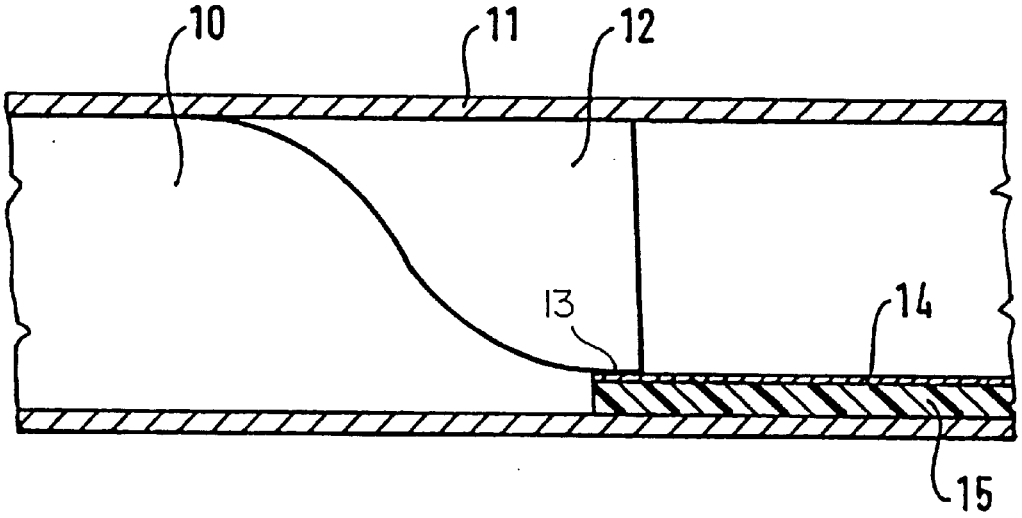
FIG.1 PRIOR ART
FIG. 1 is a section view of a known type of transition between a waveguide and a microstrip line.
Figure 2:
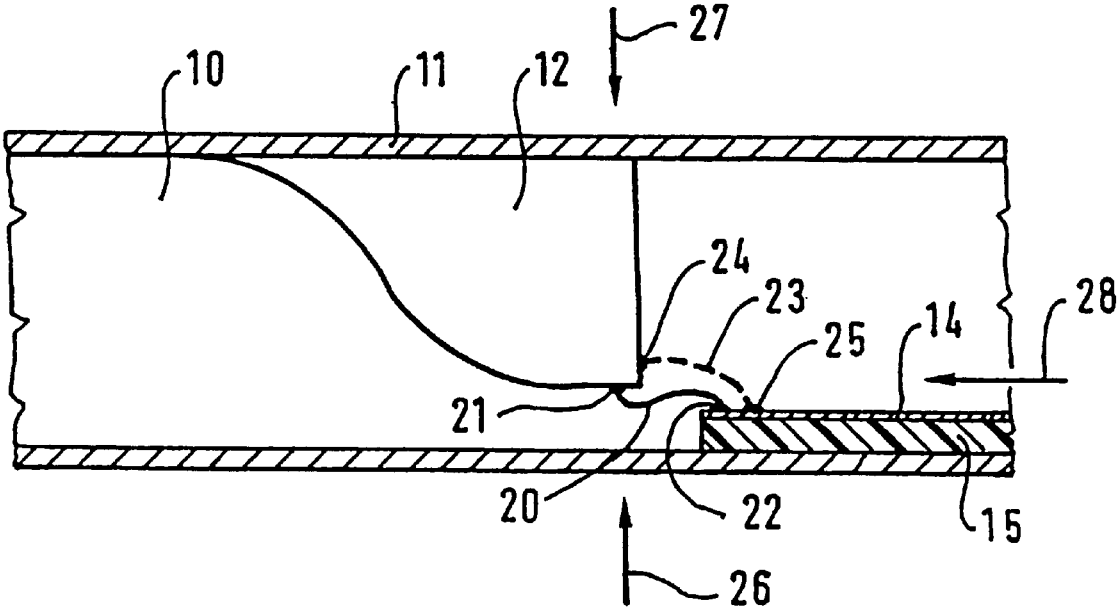
FIG.2 PRIOR ART
FIG. 2 is a section view of a transition making it possible to remedy the problems of mechanical expansion posed by the transition shown in FIG. 1.

FIGS. 1 and 2 are described above with reference to the prior art.

Figure 3:
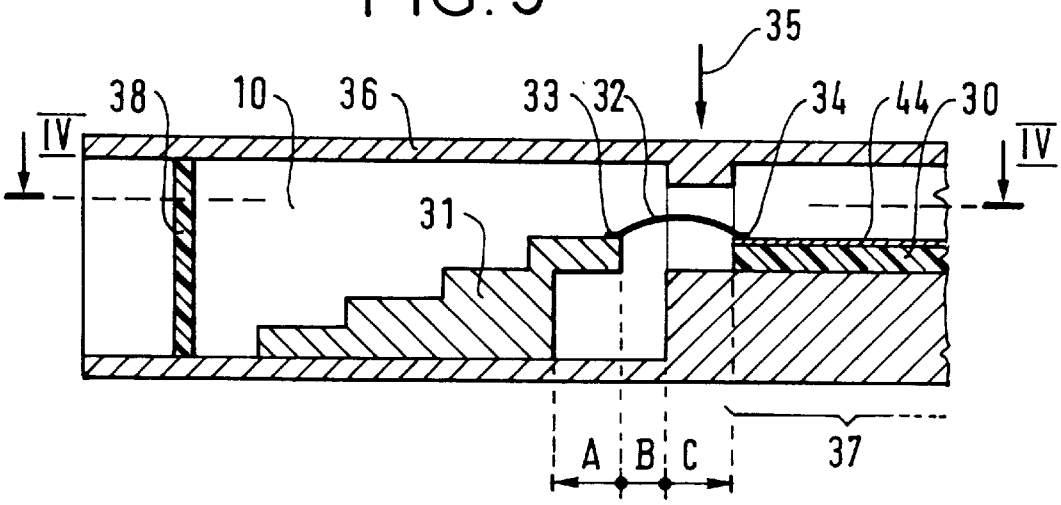
FIG. 3 is a section view of an embodiment of a transition of the present invention.
Figure 4:
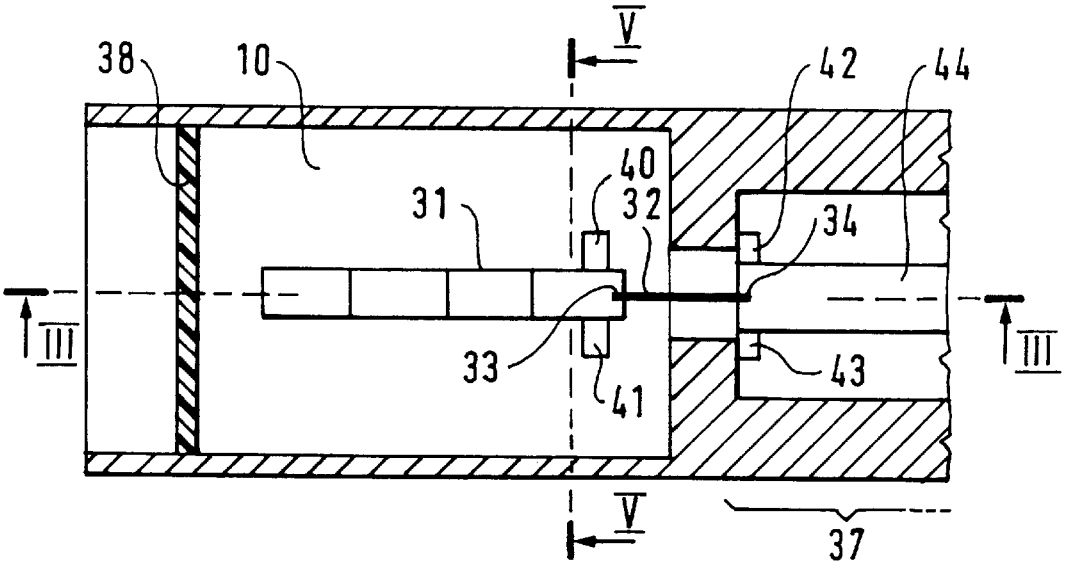
FIG. 4 is a section view on IV—IV of FIG. 3.
Figure 5:
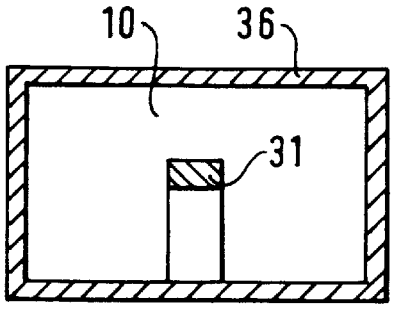
FIG. 5 is a section view on V—V of FIG. 4.

FIGS. 3–5 illustrate a preferred embodiment.

FIG. 3 is a section view of an embodiment of a transition of the present invention.

In this embodiment, as shown in FIGS. 3–5, the planar circuit is referenced 30, the ridge (stepped in this example for performing impedance transformation) is referenced 31, and the conductive link connecting the end of the ridge 31 to the conductor provided on the planar circuit 30 is referenced 32.

According to the invention, the contact points 33 and 34 at which the link 32 is in contact respectively with the ridge 31 and with the planar circuit 30 face a common access provided for putting the conductive link in place. It is thus possible to put the link 32 in place by means of a machine having access to the ends of the link 32 in a common access direction, referenced 35. As a result, the transition is easy to manufacture industrially, it being possible for the contact points 33 and 34 to be made by a thermocompression machine before the cover 36, as shown in FIG. 3 is put in place.

FIG. 3 shows three waveguide segments. In segment A, a recess is provided under the top portion of the end of the ridge 31 so as to enable the field lines to be transformed into a mode of propagation of the coaxial cable type. Segment B corresponds to the end of the ridge 31 being set back from the wall on which the planar circuit 30 stands. The purpose of setting back the end of the ridge is to enable the magnetic or H field to loop. The dimensions of the segment C may advantageously be optimized so as provide capacitive compensation for the transition.

As shown in FIGS. 3 and 4, the planar circuit 30 is preferably received in a waveguide segment 37 under the cutoff frequency so as to prevent higher-order guided modes from propagating. In other words, the planar circuit is placed in the segment 37, which is of a size such that the signal propogation is not in a waveguide mode. For this purpose, the width of the waveguide segment 37 in which the planar circuit 30 is placed must be sufficiently narrow.

The planar circuit 30 is preferably received in a recess guaranteeing that it is positioned correctly.

A sealing window 38 is advantageously placed in the waveguide 10. This sealing window 38 is made of quartz, alumina, or cordierite, and its function is to protect the planar circuit 30 from certain gases, in particular from hydrogen, and from humidity. In this case, the transition is confined in an atmosphere which is inert, and as a result integration is achieved hermetically.

As shown in FIG. 4, which is a section view on IV—IV of FIG. 3, the end of the ridge 31 is advantageously provided with two studs 40, 41 for capacitively compensating the conductive link 32, such a link being of the inductive type. Similarly, the planar circuit 30 may also be provided with two studs 42, 43, also shown in FIG. 4 performing the same function.

The section on III—III in FIG. 4 corresponds to the section shown in FIG. 3.

As shown in FIGS. 3 and 4, the link 32 may also be implemented by means of a plurality of conductors in parallel so as to reduce its impedance. The conductor of the planar circuit 30 is referenced 44.

As shown in FIG. 5, which is a section view on V—V of FIG. 4, the waveguide 10 with the ridge 31 is advantageously located below the cover 36.

Figure 6:
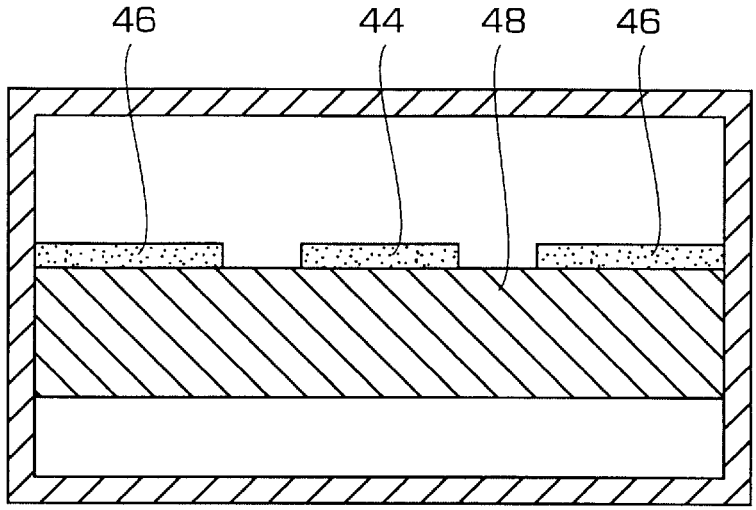
FIG. 6 is a section view on VI—VI of FIG. 3 of a coplanar circuit.
Figure 7:
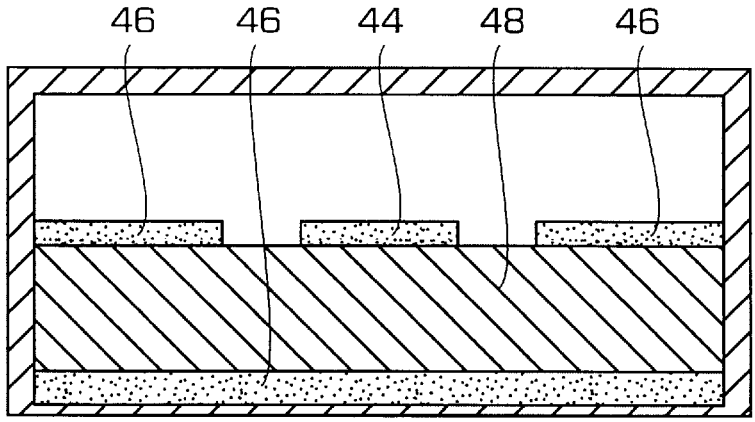
FIG. 7 is a section view of a coplanar circuit with a ground plane.
Figure 8:
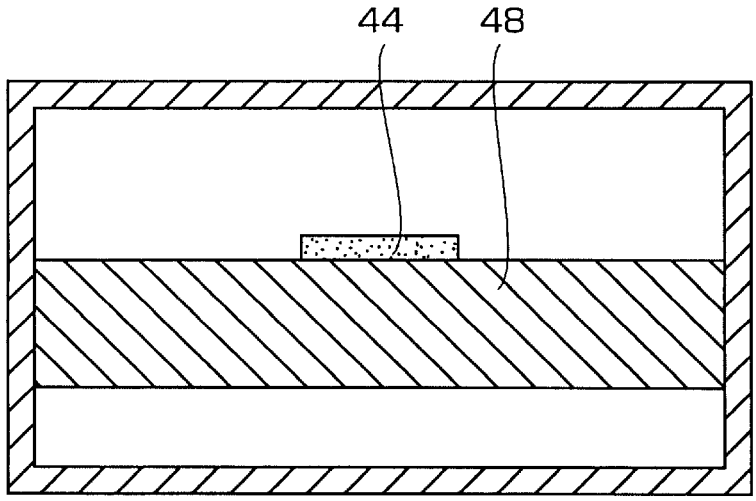
FIG. 8 is a section view of a suspended micro-strip circuit.

The invention applies generally to any planar circuit constituted by a support for a conductor, regardless of whether it is made using microstrip technology (ground plane under the substrate), using coplanar technology (ground planes 46 on either side of the central conductor 44, substrate 48 below the central conductor 44 as shown in FIG. 6), using coplanar-with-ground-plane technology (ground planes 46 on either side of central conductor 44, substrate 48 and ground plane 46 below the central conductor 44, respectively, as shown in FIG. 7), or using suspended microstrip technology (substrate 48 below the central conductor 44, as shown in FIG. 8).

The invention applies not only to ridges having varying dimensions for performing impedance-matching functions, but also to ridges whose top end is constantly at the same distance from the bottom on which said ridge stands.

The invention is particularly applicable to WR22 and WR19 waveguides, in particular in the 40 GHz to 60 GHz band. It is also applicable to circular waveguides.

We claim:

1. A transition between a ridge of a waveguide and a planar circuit on which a conductor is provided, said transition including at least one unitary conductive link directly connected at one end thereof to an end surface of said ridge at a first contact point and directly connected at an opposite end thereof to a surface of said conductor at a second contact point, respectively;

wherein said end surface and said conductor surface face in the same direction so that a common access can be used for putting said conductive link in place.

2. A transition according to claim 1, wherein said planar circuit is a microstrip circuit.

3. A transition according to claim 1, wherein said planar circuit is a coplanar circuit.

4. A transition according to claim 1, wherein said planar circuit is a coplanar circuit with a ground plane.

5. A transition according to claim 1, wherein said planar circuit is a suspended micro-strip circuit.

6. A transition according to claim 1, wherein said planar circuit is placed in a segment where a signal frequency is below a waveguide cutoff frequency of said waveguide.

7. A transition according to claim 1, wherein said contact points are thermocompressed contact points.

8. A transition according to claim 1, including a sealing window placed in said waveguide.

9. A transition according to claim 1, wherein said ridge includes an impedance transformer.

10. A transition according to claim 9, wherein said ridge is set back from a wall of the waveguide on which said planar circuit stands.

11. A transition according to claim 9, wherein said ridge is provided with a recess therein.

12. A transition between a ridge of a waveguide and a planar circuit on which a conductor is provided, said transition including at least one unitary conductive link directly connected at one end thereof to an end of said ridge at a first contact point and directly connected at an opposite end thereof to said conductor at a second contact point, respectively;

wherein said contact points face in the same direction so that a common access can be used for putting said conductive link in place; and wherein said ridge is set back from a wall of the waveguide on which said planar circuit stands.

* * * * *